US011094304B2

(12) United States Patent
Klein

(10) Patent No.: US 11,094,304 B2
(45) Date of Patent: Aug. 17, 2021

(54) MUTE HOLDER

(71) Applicant: Steven Klein, Monterey Park, CA (US)

(72) Inventor: Steven Klein, Monterey Park, CA (US)

(73) Assignee: Steven Klein, Monterey Park, CA (US)

( * ) Notice: Subject to any disclaimer, the term of this patent is extended or adjusted under 35 U.S.C. 154(b) by 0 days.

(21) Appl. No.: 16/730,757

(22) Filed: Dec. 30, 2019

(65) Prior Publication Data

US 2021/0201862 A1 Jul. 1, 2021

(51) Int. Cl.
*G10G 7/00* (2006.01)

(52) U.S. Cl.
CPC ..... *G10G 7/00* (2013.01)

(58) Field of Classification Search
CPC ..... G10G 7/00
USPC ..... 84/453
See application file for complete search history.

(56) References Cited

U.S. PATENT DOCUMENTS 1,262,163 A * 4/1918 Beethoven ..... G09F 7/18 248/230.8
1,342,136 A * 6/1920 Smith ..... G10G 5/00 248/229.1
1,409,609 A * 3/1922 Stockle ..... A47C 29/006 135/96
1,592,643 A * 7/1926 O'Leary ..... G10G 5/00 248/230.7
1,777,823 A * 10/1930 Bernard ..... G10D 9/06 84/400
1,975,303 A * 10/1934 Walker ..... G10G 5/00 248/125.1
2,559,739 A * 7/1951 Sherman ..... G10G 5/00 211/70
2,591,041 A * 4/1952 Berg ..... G10G 5/00 211/86.01
2,607,497 A * 8/1952 Carlini ..... G10D 9/06 211/87.01
2,749,073 A * 6/1956 Guysi ..... A47G 29/093 248/231.41
3,194,403 A * 7/1965 Horn, Jr. ..... A47F 5/04 211/78
4,611,722 A * 9/1986 Teig ..... G10D 9/06 211/107
4,759,252 A * 7/1988 Occhipinti ..... A47B 19/002 248/229.11
4,832,299 A * 5/1989 Gorton ..... A61G 7/05 248/231.71

(Continued)

FOREIGN PATENT DOCUMENTS

GB 2401475 A * 11/2004 ..... G10D 9/06

*Primary Examiner* — Christina M Schreiber
(74) *Attorney, Agent, or Firm* — Elizabeth Yang

(57) ABSTRACT

A mute holder for a music stand includes a mute supporting plate having a plurality of mute supporting through holes for holding mutes, a non-continuous flat bottom edge, and a curved front edge forwardly extended from the flat bottom edge; a locking mechanism having a half-circular locking ring having one end attached on the flat bottom edge of the mute supporting plate and an opposite free end pivotably rotated with respect to the flat bottom edge of the mute supporting plate to lock the free end thereon and to release from the passes supporting plate; wherein the locking mechanism further includes a locking screw passing through the half-circular locking ring and to be biased against the music stand for locking thereon.

5 Claims, 5 Drawing Sheets

(56) References Cited

U.S. PATENT DOCUMENTS

| | | | | | |
|---|---|---|---|---|---|
| 5,114,023 | A * | 5/1992 | Lavin | A47B 57/54 | 211/107 |
| 5,322,253 | A * | 6/1994 | Stevens | F16M 13/022 | 248/125.1 |
| 5,634,619 | A * | 6/1997 | Alessi | A47B 57/565 | 248/219.3 |
| 5,996,511 | A * | 12/1999 | Swoger | A47B 57/26 | 108/151 |
| 6,143,970 | A * | 11/2000 | Kowzan | G10D 3/046 | 211/70.1 |
| 6,164,464 | A * | 12/2000 | Auke | G09F 3/16 | 211/85.6 |
| 6,588,716 | B1 * | 7/2003 | Heid | A47B 19/002 | 248/125.8 |
| 7,060,040 | B2 * | 6/2006 | Farmer | F21S 6/003 | 600/573 |
| 7,527,600 | B2 * | 5/2009 | Farmer | F21V 33/00 | 600/573 |
| 7,959,122 | B1 * | 6/2011 | Clack-Hopkins | A61M 5/1417 | 248/316.7 |
| 8,003,870 | B1 * | 8/2011 | PetroRoy | G10D 9/06 | 84/421 |
| 8,136,458 | B1 * | 3/2012 | Cass | D06F 53/005 | 108/50.12 |
| 9,107,496 | B2 * | 8/2015 | Lindo | A47B 57/565 | |
| 10,593,310 | B2 * | 3/2020 | Klein | G10D 3/046 | |
| 2018/0190246 | A1 * | 7/2018 | Klein | G10D 9/06 | |
| 2019/0019481 | A1 * | 1/2019 | Klein | G10G 7/00 | |
| 2019/0244592 | A1 * | 8/2019 | Klein | G10D 3/046 | |

* cited by examiner

MUTE HOLDER

FIELD OF THE DISCLOSURE

The present disclosure relates to a mute holder, and particularly to a mute holder with a quick-release locking mechanism, wherein the mute holder may be released from a music stand by a one-step operation without adjusting a locking screw.

BACKGROUND OF THE DISCLOSURE

Generally, a mute holder is a device for holding mutes on a music stand while a musician is playing the instrument. The traditional mute holder comprises a mute supporting plate, and a locking mechanism adapted to lock the mute holder on the music stand, and the clamps and the screws are two of the most popular mechanism to apply thereon.

One popular mute holder is to use the clamp to hold the mute supporting plate on the music stand. However, clamps are not efficient tools to securely hold the mute holder on the music stand. The mute holder is easily falling down from the music stand while several mutes are supported on the mute supporting plate. In addition, the mute holder is mounted on the music stand only via a point where the clamps are coupled thereon, so the clamps are easy to malfunction after the frequently used.

The other popular mute holder is to use the screws to lock the mute supporting plate on the music stand. The user needs to adjust the screws to bias against the music stand and adjust the screws to release the mute holder from the music stand. Therefore, this mute holder can provide a more stable mounting structure to prevent the mute holder from falling down from the music stand. However, it is a hassle to adjust the screws every time in order to detach the mute holder from the music stand.

There may exist a desire to develop a mute holder with a quick-release mechanism that can facilitate the user to detach the mute holder in a more simple and efficient way.

All referenced patents, applications, and literatures are incorporated herein by reference in their entirety. Furthermore, where a definition or use of a term in a reference, which is incorporated by reference herein, is inconsistent or contrary to the definition of that term provided herein, the definition of that term provided herein applies and the definition of that term in the reference does not apply. The disclosed embodiments may seek to satisfy one or more of the above-mentioned desires. Although the present embodiments may obviate one or more of the above-mentioned desires, it should be understood that some aspects of the embodiments might not necessarily obviate them.

BRIEF SUMMARY OF THE DISCLOSURE

In a general implementation, a mute holder for a music stand includes a mute supporting plate having a plurality of mute supporting through holes for holding mutes, a non-continuous flat bottom edge, and a curved front edge forwardly extended from the flat bottom edge; a locking mechanism comprising a half-circular locking ring having one end attached on the flat bottom edge of the mute supporting plate and an opposite free end pivotably rotated with respect to the flat bottom edge of the mute supporting plate to lock the free end thereon and to release from the mute supporting plate; wherein the locking mechanism further comprises a locking screw passing through the half-circular locking ring and to be biased against the music stand for locking thereon.

In another aspect combinable with the general implementation, at least one of the flat bottom edge comprises a broken cut edge inwardly extended to form a U-shaped cavity where the music stand passes therethrough.

In another aspect combinable with the general implementation, at least one of the U-shaped reinforced members fixed along a periphery of the U-shaped cavity via a plurality of fixing screws.

In another aspect combinable with the general implementation, at least one of the locking mechanism further comprises a first screw passing through the one end of the half-circular locking ring and to be fixed on a first end of the U-shaped reinforced member and a second screw fixed on a second end of the U-shaped reinforced member.

In another aspect combinable with the general implementation, at least one of the one end of the half-circular locking ring is sandwiched between a first screw head of the first screw and the first end of the U-shaped reinforced member to retain the one end of the half-circular locking ring being pivotally attached on the first end of the U-shaped reinforced member in a rotatable position.

In another aspect combinable with the general implementation, at least one of the free end of the half-circular locking ring comprises a retaining notch shaped to be locked on a second body portion of the second screw.

In another aspect combinable with the general implementation, at least one of the one end of the half-circular locking ring is overlappedly arranged with on the first end of the U-shaped reinforced member, and the free end of the half-circular locking ring is overlappedly arranged with the second end of the U-shaped reinforced member.

In another aspect combinable with the general implementation, the locking mechanism further comprises an oval space where the music stand passes through, and the locking screw moves in the space to bias against the music stand.

In another aspect combinable with the general implementation, at least one of the locking screw moves towards the music stand in a vertical direction to lock the mute holder on the music stand and moves away from the music stand in the vertical direction to release the mute holder.

In another aspect combinable with the general implementation, at least one of the locking screw passes through a center point of the half-circular ring to divide the half-circular ring in half.

Another aspect of the embodiment is directed to methods of mounting a mute holder on a music stand, the method comprises:

Disposing the music stand in a U-shaped cavity formed on a mute supporting plate, Rotating a half-circular ring via an end of the half-circular ring being pivotally attached on a U-shaped reinforced member fixed on the mute supporting plate, Locking a free end of the half-circular ring on a second screw fixed on a second end of the U-shaped reinforced member, Adjusting a locking screw to bias against the music stand and to lock the music stand between an inward surface of the U-shaped cavity and the locking screw.

In another aspect combinable with the general implementation, at least one of the locking screw passes through a center point of the half-circular ring to divide the half-circular ring in half.

In another aspect combinable with the general implementation, at least one of the steps of rotating further comprises a step of anti-clockwisely rotating the half-circular ring to unlock the free end of the half-circular ring from the second screw.

In another aspect combinable with the general implementation, at least one of the steps of rotating further comprises a step of clockwisely rotating the half-circular ring to lock the free end of the half-circular ring on the second screw.

In another aspect combinable with the general implementation, at least one of the locking screw moves towards and is locked on the music stand in a vertical position, and the mute supporting plate is suspended on the music stand in a vertical position.

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above and below as acting in certain combinations and even initially claimed as such, one or more features from a claimed combination can in some cases be excised from the combination, and the claimed combination may be directed to a subcombination or variation of a subcombination.

A number of implementations have been described. Nevertheless, it will be understood that various modifications may be made without departing from the spirit and scope of the disclosure. For example, for example, operations, methods, or processes described herein may include more steps or fewer steps than those described. Further, the steps in such example, operations, methods, or processes may be performed in different successions than that described or illustrated in the figures. Accordingly, other implementations are within the scope of the following claims.

The details of one or more implementations of the subject matter described in this disclosure are set forth in the accompanying drawings and the description below. Other features, aspects, and advantages of the subject matter will become apparent from the description, the drawings, and the claims.

BRIEF DESCRIPTION OF THE DRAWINGS

It should be noted that the drawing figures may be in simplified form and might not be to a precise scale. In reference to the disclosure herein, for purposes of convenience and clarity only, directional terms such as top, bottom, left, right, up, down, over, above, below, beneath, rear, front, distal, and proximal are used with respect to the accompanying drawings. Such directional terms should not be construed to limit the scope of the embodiment in any manner.

DETAILED DESCRIPTION OF THE EMBODIMENTS

The different aspects of the various embodiments can now be better understood by turning to the following detailed description of the embodiments, which are presented as illustrated examples of the embodiments defined in the claims. It is expressly understood that the embodiments as defined by the claims may be broader than the illustrated embodiments described below.

Figure 1:
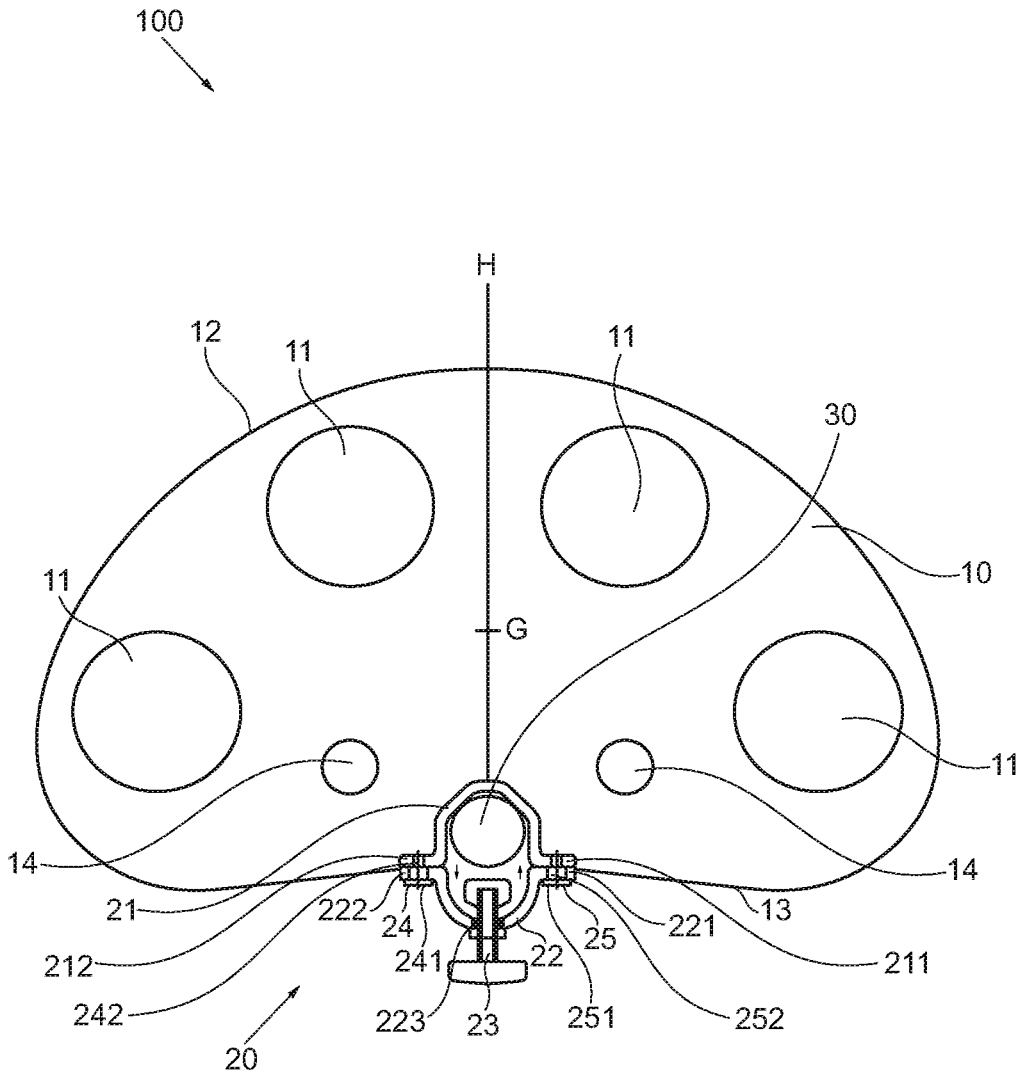
FIG. 1 is a top view of a mute holder according to an aspect of the embodiment.

FIG. 1 general depicts the basic architecture of a mute holder in accordance with one of the disclosed embodiments.

The mute holder 100 comprises a mute supporting plate 10 and a locking mechanism 20 cooperated with the mute supporting plate 10 to lock the mute holder 100 on a music stand 30, wherein the locking mechanism 20 can be formed along a central line H of the mute supporting plate 10. Therefore, the locking mechanism 20 can be locked to the music stand 30 in a locking position with an equal weight of two parts of the mute supporting plate 10 divided by the central line H and can be unlocked from the music stand 30 in an unlocking position.

In one embodiment, the mute supporting plate 10 can comprise a plurality of mute supporting through holes 11 and a plurality of tool supporting through holes 14. The mute supporting through-holes 11 can be formed along a periphery of the mute supporting plate 10 in an equidistant arrangement, and each of the mute supporting through-holes 11 is identical. In addition, the tool supporting through-holes 14 can be symmetrically formed on two parts of the mute supporting plate 10, and in other words, the mute supporting through-holes 10 can be symmetrically formed on two parts of the mute supporting plate 10.

Figure 2:
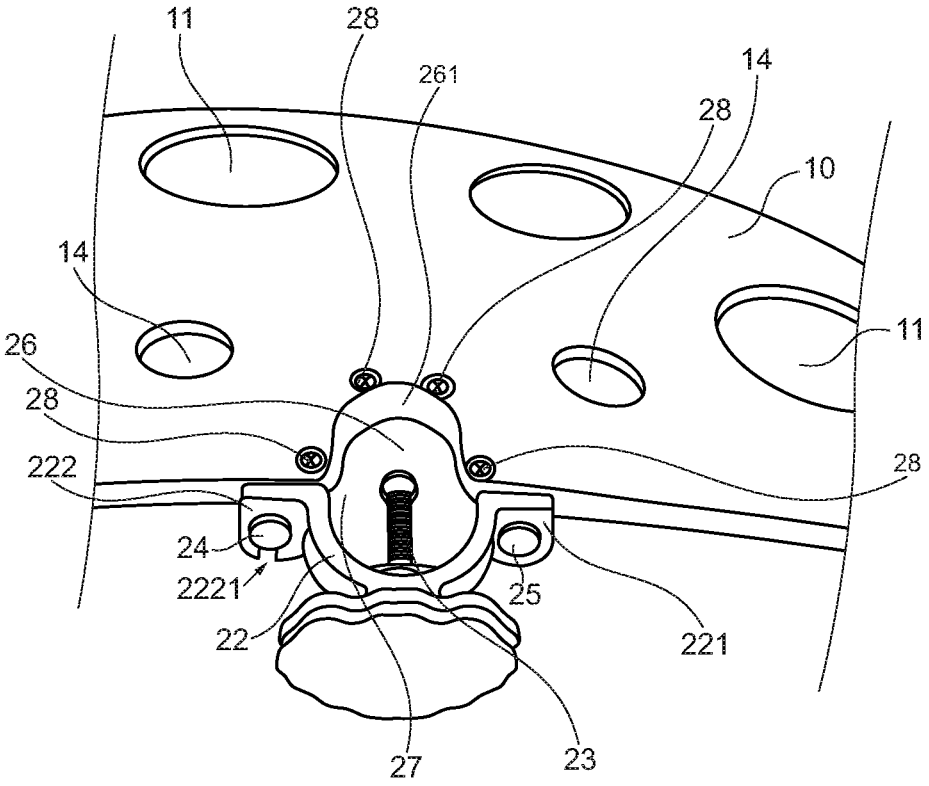
FIG. 2 is a side view of a locking mechanism of the mute holder according to the aspect of the embodiment, illustrating the locking mechanism being in a locking position.

The mute supporting plate 10 of FIG. 1 further can comprise a continuous curved front edge 12 and a non-continuous bottom edge 13 integrally extended from the curved front edge 12. Referring now to the detail of FIG. 2, the mute supporting plate 10 further can comprise a U-shaped cavity 26, which is cut from the bottom edge and having an inward surface 261, wherein the U-shaped cavity 26 can be sized to accommodate the music stand 30. In other words, the inward surface 261 also may be shaped to accommodate the music stand 30.

As shown further in FIG. 1, the locking mechanism 20 comprises a U-shaped reinforced member 21 having a first end 211 and an opposite second end 212 and fixed on the mute supporting plate 10 along a periphery of the U-shaped cavity 26, and a half-circular ring 22 having one end 221 rotatably attached to the first end 211 of the U-shaped reinforced member 21 and an opposite free end 222, wherein the locking mechanism 20 may further comprise a first screw 25 passing through the one end 221 of the half-circular ring 22 and fixed on the first end 211 of the U-shaped reinforced member 21, and a second screw 24 fixed on the second end 212 of the U-shaped reinforced member 21.

In one embodiment, in a locking position of the locking mechanism 20, as shown in FIG. 1, the one end 221 of the half-circular ring 21 may be rotatably attached on a first body portion 252 of the first screw 25 and may be blocked by a first screw head 251 of the first screw 25, wherein the one end 221 of the half-circular ring 22 may be overlappedly arranged with the bottom edge, and the first end 211 of the U-shaped reinforced member 21. In other words, the one end 221 of the half-circular ring 22 may be sandwichedly located between the first screw head 251, and the bottom edge and the first end 211 of the U-shaped reinforced member 21.

In one aspect, the free end 222 of the half-circular ring 22 may comprise a retaining notch 2221 which is shaped to match with a second screw body 242 of the second screw 24, wherein the free end 222 of the half-circular ring 22 may be blocked by the second head 241 of the second screw 24. In other words, the free end 222 of the half-circular ring 22 may be sandwichedly located between a second screw head 241 of the second screw 24, and the bottom edge and the second end 212 of the U-shaped reinforced member 21.

In another aspect, the locking mechanism 20 may further comprise a locking screw 23 passing through a central point 223 of the half-circular locking ring 22, wherein the locking screw 23 may be adjusted to be biased against the music stand 30 for locking thereon. In the locking position of the locking mechanism 20, the music stand 30 may be disposed in the U-shaped cavity 26, and the locking screw 23 may be adjusted to move towards the music stand 30 and biased against one side of music stand 30, and at the same time, an opposite side of the music stand 30 may be biased against the inner surface 261 of the U-shaped cavity 26. Therefore, in this situation, the mute supporting plate 10 may be mounted on the music stand 30 by the locking mechanism 20.

In other words, the mute holder 100 can be mounted on the music stand 30 in a stable balance where the locking screw 23 may be located along the central line H of the mute supporting plate 10 while the locking mechanism 20 may be in the locking position. Accordingly, the locking screw 23 may be moved towards the music stand 30 in a vertical position. Therefore, the locking screw 23 may be arranged with respect to the music stand 30 in a vertical arrangement while the mute supporting plate 10 is mounted on the music stand 30.

In yet another aspect, the half-circular ring 22 may be attached to the U-shaped reinforced member 21 to form an oval-shaped space 27 where the music stand 30 passes through, and the locking screw 23 freely moves therein.

In still yet another aspect, the locking mechanism 20 further comprises a plurality of fixing screws 28 adopted to fix the U-shaped reinforced member 21 on the mute supporting plate 10. It should be understood the above-described way to fix the U-shaped reinforced member 21 on the mute supporting plate 10 is exemplary, and any other ways can be adopted in various embodiments of this disclosure.

Figure 3:
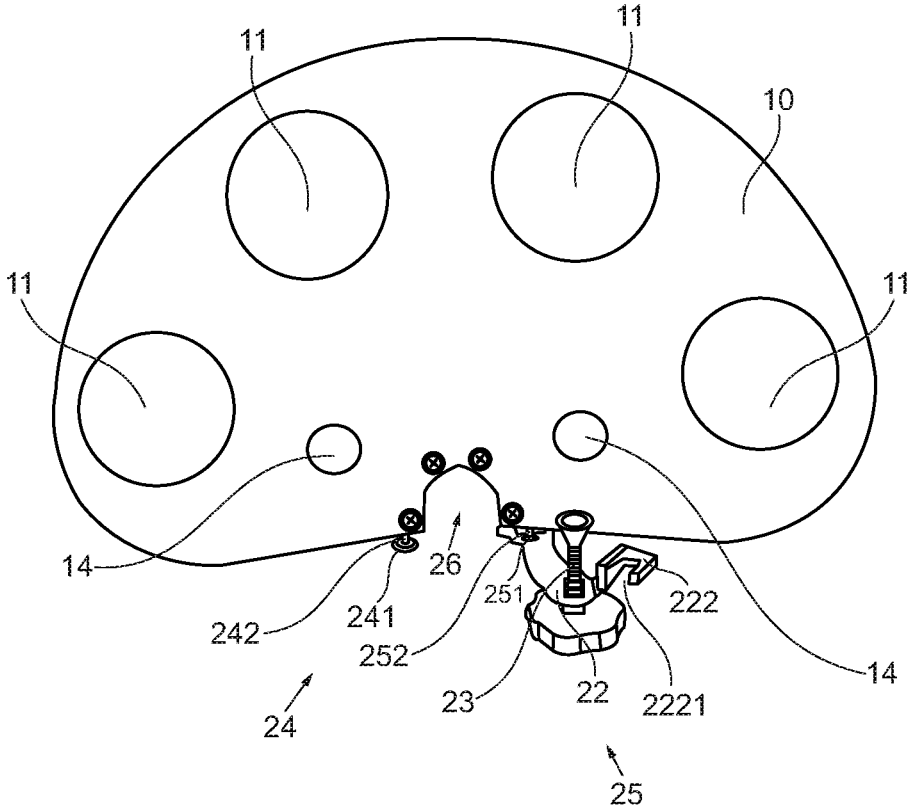
FIG. 3 is a top view of the locking mechanism of the mute holder according to the aspect of the embodiment, illustrating the locking mechanism being in an unlocking position.

FIG. 3 generally depicts a perspective view of the mute holder 100 in accordance with one of the disclosed embodiments, illustrating the locking mechanism 20 being in the unlocking position.

The half-circular ring 22 may be clockwisely rotated to release the retaining notch 2221 from the second screw body 242 of the second screw 24, and in this situation, the locking screw 23 may be directedly detached from the music stand 30 without any adjustment. Therefore, the user may use only one-step operation for rotating the half-circular ring 22 so as to detach mute holder 100 from the music stand 30.

In one aspect, the half-circular ring 22 may be anticlockwisely rotated to lock the free end 222 thereof on the second screw body 242 of the second screw 24, and then the locking screw 23 may be vertically adjusted to move towards the music stand 30 to lock it located between the inner surface 261 of the U-shaped cavity 26 and the locking screw 23.

Figure 4:
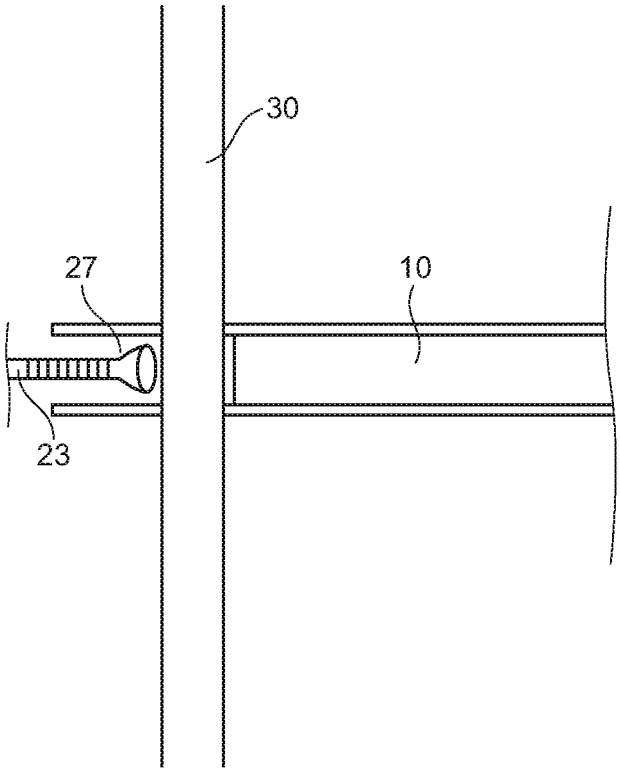
FIG. 4 is a sectional view of the locking mechanism of the mute holder according to the aspect of the embodiment, illustrating a locking screw being biased against a music stand.

FIG. 4 generally depicts a perspective view of the mute holder 100 in accordance with one of the disclosed embodiments. The mute supporting plate 10 may be mounted on the music stand 30 in a vertical arrangement since the locking screw 30 may be vertically moved towards and then be biased against the music stand, wherein the music stand 30 may be passed through the U-shaped cavity 26 and may be located in the vertical arrangement with respect to the mute supporting plate 10, and at the same time, the locking screw 23 may also be located in the vertical arrangement with respect to the music stand 30. Indeed, the locking screw 23 may be moved towards the music stand 30 to force it to be biased against the inner surface 261 of the U-shaped cavity 26.

In yet another embodiment, the half-circular ring 22 may be attached to the mute supporting plate 10 without the U-shaped reinforced member 21. The first screw 25 may be fixed to the bottom edge of the mute supporting plate 10, and the second screw 24 may also be fixed to the bottom edge of the mute supporting plate 10. Therefore, in this embodiment, the one end 221 of the half-circular ring 22 may be rotatably attached on the bottom edge of the mute supporting plate 10 by the first screw 25, wherein the first screw 25 may pass through the one end 221 of the half-circular ring 22 and fixed on the bottom edge of the mute supporting plate 10, and in this situation, the one end 221 of the half-circular ring 22 may be freely rotated with respect to the first body portion 252 of the first screw 25. In other words, the one end 221 of the half-circular ring 22 may be overlappedly arranged with the bottom edge of the mute supporting plate 10.

In one aspect, the free end 222 of the half-circular ring 22 may be locked on the second body portion 242 of the second screw 24 with the overlappedly arrangement between the free end 222 of the half-circular ring 22 and the bottom edge of the mute supporting plate 10.

In another aspect, the retaining notch 2221 of the free end 222 of the half-circular ring 22 may have a downwardly-formed opening. Therefore, the retaining notch 2221 of the free end 222 of the half-circular ring 22 may be moved from top to bottom to match the retaining notch 2221 with the second body portion 242 of the second screw 24.

In yet another aspect, a bottom edge of the retaining notch 2221 may be slightly smaller than a diameter of the retaining notch 2221, and the free end 222 of the half-circular ring 22 may be made of elastic materials. Therefore, the bottom edge of the half-circular ring 22 may be slightly deformed to pass through the second body portion 242 of the second screw 24 and reinstate to its original shape to remain thereon.

Figure 5:
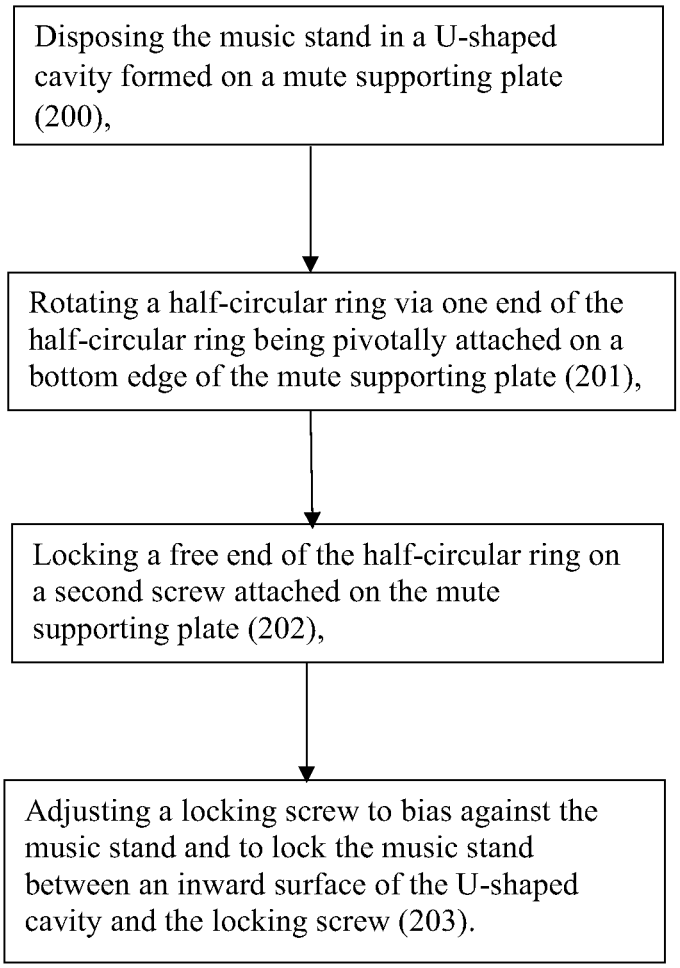
FIG. 5 is a block diagram of a method for mounting a mute holder on a music stand in accordance with one of the disclosed embodiments.

FIG. 5 generally depicts a method for mounting a mute holder on a music stand in accordance with one of the disclosed embodiments.

The contemplated embodiment may comprise steps of:

A method of mounting a mute holder on a music stand, the method comprises:

Disposing the music stand in a U-shaped cavity formed on a mute supporting plate (200), Rotating a half-circular ring via one end of the half-circular ring being pivotally attached on a bottom edge of the mute supporting plate (201), Locking a free end of the half-circular ring on a second screw attached on the mute supporting plate (202), Adjusting a locking screw to bias against the music stand and to lock the music stand between an inward surface of the U-shaped cavity and the locking screw (203).

In one embodiment, the one end of the half-circular ring may be attached on the bottom edge of the mute supporting plate via a first screw and a U-shaped reinforced member fixed on the mute supporting plate, wherein the first screw may pass through the one end of the half-circular ring and be fixed on a second end of the U-shaped reinforced member, and at the same time, the one end of the half-circular ring may be freely rotated with respect to the first screw fixed on a first end of the U-shaped reinforced member.

In this embodiment, the step of locking further comprises a step of overlappedly attaching the free end of the half-circular ring with the second end of the U-shaped reinforced member.

In addition, the step of attaching further comprises a step of matching a retaining notch with a second body portion of the second screw to lock the free end with the second screw.

In another embodiment, in the step of locking the free end of the half-circular ring, the second screw may be fixed on a first end of the U-shaped reinforced member fixed on the mute supporting plate.

In yet another embodiment, in the step of adjusting the locking screw, the locking screw may pass through a center point of the half-circular ring to divide the half-circular ring in half.

In still yet another embodiment, the step of rotating further comprises a step of anti-clockwisely rotating the half-circular ring to unlock the free end of the half-circular ring from the second screw.

In addition, the step of rotating further comprises a step of clockwisely rotating the half-circular ring to lock the free end of the half-circular ring on the second screw.

In still yet another embodiment, the method may further comprise a step of adjusting the locking screw to move away from the music stand and to release the music stand.

In addition, the step of anti-clockwisely rotating may further comprise a step of directly moving the locking screw away from the music stand to release the music stand.

In still yet another embodiment, the locking screw may move towards and be locked on the music stand in a vertical position, and the mute supporting plate is suspended on the music stand in a vertical position.

Similarly, while operations and/or methods may be depicted in the drawings in a particular order, this should not be understood as requiring that such operations be performed in the particular order shown or in sequential order, or that all illustrated operations and/or method steps be performed, to achieve desirable results. In certain circumstances, multitasking and parallel processing may be advantageous.

Many alterations and modifications may be made by those having ordinary skill in the art without departing from the spirit and scope of the disclosed embodiments. Therefore, it must be understood that the illustrated embodiments have been set forth only for the purposes of example and that it should not be taken as limiting the embodiments as defined by the following claims. For example, notwithstanding the fact that the elements of a claim are set forth below in a certain combination, it must be expressly understood that the embodiment includes other combinations of fewer, more or different elements, which are disclosed herein even when not initially claimed in such combinations.

Thus, specific embodiments and applications of the mute holder have been disclosed. It should be apparent, however, to those skilled in the art that many more modifications besides those already described are possible without departing from the disclosed concepts herein. The disclosed embodiments, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Insubstantial changes from the claimed subject matter as viewed by a person with ordinary skill in the art, now known or later devised, are expressly contemplated as being equivalents within the scope of the claims. Therefore, obvious substitutions now or later known to one with ordinary skill in the art are defined to be within the scope of the defined elements. The claims are thus to be understood to include what is specifically illustrated and described above, what is conceptually equivalent, what can be obviously substituted and also what essentially incorporates the essential idea of the embodiments. In addition, where the specification and claims refer to at least one of something selected from the group consisting of A, B, C . . . and N, the text should be interpreted as requiring at least one element from the group which includes N, not A plus N, or B plus N, etc.

The words used in this specification to describe the various embodiments are to be understood not only in the sense of their commonly defined meanings but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims, therefore, include not only the combination of elements which are literally set forth but all equivalent structure, material or acts for performing substantially the same function in substantially the same way to obtain substantially the same result. In this sense, it is therefore contemplated that an equivalent substitution of two or more elements may be made for anyone of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

What is claimed is:

1. A mute holder for a music stand comprising:

a mute supporting plate having a plurality of mute supporting through holes for holding mutes, a non-continuous flat bottom edge, and a curved front edge forwardly extended from the flat bottom edge;

a locking mechanism comprising a half-circular locking ring having one end attached on the flat bottom edge of the mute supporting plate and an opposite free end pivotably rotated with respect to the flat bottom edge of the mute supporting plate to lock the opposite free end to the mute supporting plate and to release from the mute supporting plate; wherein the locking mechanism further comprises a locking screw passing through the half-circular locking ring and to be biased against the music stand for locking thereon;

wherein the flat bottom edge comprises a broken cut edge inwardly extended to form a U-shaped cavity where the music stand passes therethrough;

wherein the locking mechanism further comprises a U-shaped reinforced member fixed along a periphery of the U-shaped cavity via a plurality of fixing screws;

wherein the locking mechanism further comprises a first screw passing through the one end of the half-circular locking ring and the first screw is fixed on a first end of the U-shaped reinforced member and a second screw fixed on a second end of the U-shaped reinforced member;

wherein the one end of the half-circular locking ring is rotatably attached on a first body portion of the first screw and is sandwiched between a first screw head of the first screw and the first end of the U-shaped reinforced member to retain the one end of the half-circular locking ring being attached on the first end of the U-shaped reinforced member in a rotatable position;

wherein the opposite free end of the half-circular locking ring comprises a retaining notch shaped to be locked on a second body portion of the second screw.

2. The mute holder, as recited in claim 1, wherein the one end of the half-circular locking ring is overlappedly arranged with the first end of the U-shaped reinforced member and the opposite free end of the half-circular locking ring is overlappedly arranged with the second end of the U-shaped reinforced member.

3. The mute holder, as recited in claim 2, wherein the locking mechanism further comprises an oval space where the music stand pass through and the locking screw moves in the space to bias against the music stand.

4. The mute holder, as recited in claim 3, wherein the locking screw moves towards the music stand in a vertical direction to lock the mute holder on the music stand and moves away from the music stand in the vertical direction to release the mute holder.

5. The mute holder, as recited in claim 4, wherein the locking screw passes through a center point of the half-circular ring to divide the half-circular ring in half.

* * * * *